US005725611A

United States Patent [19]

Wright et al.

[11] Patent Number: 5,725,611

[45] Date of Patent: Mar. 10, 1998

[54] METHODS FOR REDUCING FOULING DEPOSIT FORMATION IN JET ENGINES

[75] Inventors: Bruce E. Wright, The Woodlands; William L. Witzig, Montgomery, both of Tex.

[73] Assignee: BetzDearborn Inc., Trevose, Pa.

[21] Appl. No.: 695,491

[22] Filed: Aug. 12, 1996

Related U.S. Application Data

[60] Division of Ser. No. 368,076, Jan. 3, 1995, Pat. No. 5,621,154, which is a continuation-in-part of Ser. No. 230,031, Apr. 19, 1994, abandoned.

[51] Int. Cl.[6] ..... C10L 1/26

[52] U.S. Cl. ..... 44/375; 44/378

[58] Field of Search ..... 44/375, 378

[56] References Cited

U.S. PATENT DOCUMENTS

| | | | |
|---|---|---|---|
| 3,256,192 | 6/1966 | Peterson et al. | 252/46.6 |
| 3,256,193 | 6/1966 | Petersen et al. | 252/46.6 |
| 3,281,359 | 10/1966 | Oberender et al. | 252/48.6 |
| 3,405,504 | 10/1968 | Arkis et al. | 208/48 |
| 3,704,107 | 11/1972 | Schlicht et al. | 44/58 |
| 4,244,828 | 1/1981 | Hodge et al. | 252/46.7 |
| 4,578,178 | 3/1986 | Forester | 208/48 AA |
| 4,775,458 | 10/1988 | Forester | 208/48 AA |
| 4,927,561 | 5/1990 | Forester | 252/389.22 |

FOREIGN PATENT DOCUMENTS

| | | |
|---|---|---|
| 476197 | 9/1990 | European Pat. Off. . |
| 1645885 | 12/1970 | Germany . |
| 940709 | 10/1963 | United Kingdom . |

*Primary Examiner*—Jacqueline V. Howard

*Attorney, Agent, or Firm*—Alexander D. Ricci; Philip H. Von Neida

[57] ABSTRACT

Methods are provided for cleaning and inhibiting the formation of fouling deposits on jet engine components during the combustion of turbine combustion fuel oils. Methods are also provided for inhibiting the formation and emission of soot and smoke from jet engine exhaust during turbine combustion fuel oil combustion. The methods employ a derivative of polyalkenylthiophosphonic acid added to the turbine combustion fuel oil. The preferred derivative is pentaerythritol ester of polyisobutenylthiophosphonic acid.

4 Claims, No Drawings

METHODS FOR REDUCING FOULING DEPOSIT FORMATION IN JET ENGINES

This is a divisional of application Ser. No. 08/368,076, filed Jan. 3, 1995 now U.S. Pat. No. 5,621,154 which is a continuation-in-part of application Ser. No. 08/230,031, filed Apr. 19, 1994, now abandoned.

FIELD OF THE INVENTION

This invention relates to methods for inhibiting fouling deposit formation on jet engine components during the combustion of finished turbine combustion fuel oils. The present invention also reduces the emission of exhaust smoke and soot and aids in engine noise reduction.

BACKGROUND OF THE INVENTION

Turbine combustion fuel oils, such as JP-4, JP-5, JP-7, JP-8, Jet A, Jet A-1 and Jet B are ordinarily middle boiling distillates, such as combinations of gasoline and kerosene. Military grade JP-4, for instance, is used in military aircraft and is a blend of 65% gasoline and 35% kerosene. Military grades JP-7 and JP-8 are primarily highly refined kerosenes, as are Jet A and Jet A-1, which are used for commercial aircraft.

Turbine combustion fuel oils often contain additives such as antioxidants, metal deactivators and corrosion inhibitors. These additives are often necessary in these fuel oils to meet defined performance and storage requirements.

Turbine combustion fuel oils are used in integrated aircraft thermal management systems to cool aircraft subsystems and the engine lubricating oil. The turbine combustion fuel oil is circulated in the airframe to match heat loads with available heat sink. In current aircraft, these thermal stresses raise bulk fuel temperatures to as high as 425° F. at the inlet to the mainburner fuel nozzles and above 500° F. inside the fuel nozzle passages. In the augmentor or afterburner systems, skin temperatures up to 1100° F. are experienced. In future aircraft, these temperatures are expected to be 100° higher.

At these high temperatures (425° F.–1100° F.) and oxygen-rich atmospheres in aircraft and engine fuel system components, fuel degrades forming gums, varnishes, and coke deposits. These deposits plug-up the components leading to operational problems including reduced thrust and performance anomalies in the augmentor, poor spray patterns and premature failure of mainburner combustors and problems with fuel controls. Further, the engine exhaust becomes smoky and sooty and engine noise increases, both of which are undesirable characteristics for jet engines.

An economical method to inhibit and control deposit formation is to add treatment chemicals to the turbine combustion fuel oils prior to their combustion as propulsion fuels. It has been surprisingly found that deposit formation can be inhibited and existing deposits removed by the addition of a derivative of polyalkenylthiophosphonic acid to the turbine combustion fuel oils. Likewise, the formation of exhaust soot and smoke is inhibited and engine noise reduced.

SUMMARY OF THE INVENTION

The present invention relates to methods for inhibiting fouling deposit formation on jet engine components during combustion. The methods utilize a derivative of polyalkenylthiophosphonic acid as a turbine combustion fuel oil additive which, when the fuel oil is combusted during jet engine operation, will clean existing fouling deposits and inhibit the formation of new fouling deposits on jet engine fuel intake and combustion components.

DESCRIPTION OF THE RELATED ART

Polyalkenylthiophosphonic acids are disclosed in U.S. Pat. No. 3,405,054 as antifoulants in petroleum refinery processing equipment. Certain polyalkenylthiophosphonic acids and alcohol or glycol esters thereof are described as useful as dispersant additives in lubricating oil in U.S. Pat. No. 3,281,359. U.S. Pat. No. 4,578,178 teaches the use of a polyalkenylthiophosphonic acid, or ester thereof, as an antifoulant in elevated temperature systems where a hydrocarbon is being processed. Multifunctional process antifoulants are disclosed in U.S. Pat. No. 4,775,458 and 4,927,561 utilizing as one component a polyalkenylphosphonic acid or alcoholpolyglycol ester thereof. The other components include an antioxidant compound, a corrosion inhibiting agent and a metal deactivator compound. These compounds are disclosed as being effective as antifoulants in refinery process streams, such as in crude oil preheat exchangers, which are essentially non-oxygen atmospheres. The testing in these examples utilized nitrogen overpressure to minimize oxygen intrusion into the systems.

DETAILED DESCRIPTION OF THE INVENTION

The present invention relates to methods for cleaning and inhibiting deposit formation on jet engine surfaces such as fuel intake and combustion components during the combustion of turbine combustion fuel oils comprising adding to the turbine combustion fuel oil prior to its combustion a derivative of a polyalkenylthiophosphonic acid (PATPA).

The present invention also relates to methods for reducing the formation and emission of particulate matter, soot and smoke from the exhaust of a jet fuel engine that is combusting turbine combustion fuel oils comprising adding to the turbine combustion fuel oil prior to its combustion a derivative of a polyalkenylthiophosphonic acid. Engine noise reduction is also realized by the use of these compounds in turbine combustion fuel oils.

Preparative routes for synthesizing the polyalkenylthiophosphonic acids and glycol esters thereof may be seen in Oberender et al., U.S. Pat. No. 3,281,359, the entire content of which is hereby incorporated by reference.

At present, the reaction product preferred for use in this invention is the pentaerythritol ester of polyalkenylthiophosphonic acid. These polymers may be prepared by reacting alkenyl polymers such as polyethylene, polypropylene, polyisopropylene, polyisobutylene, polybutene or copolymers comprising such alkenyl repeat unit moieties, with $P_2S_5$ (at about 5–40 wt percent of the reaction mass) at a temperature of from about 100° to about 320° C. in the presence of between 0.1–5.0 wt percent sulfur.

The resulting reaction mixture is then diluted with mineral oil and is then steam hydrolyzed. If desired, the hydrolyzed polyalkenyl —$P_2S_5$ reaction product may then be esterified, by further reaction with lower alkyl ($C_1$–$C_5$) alcohols such as methanol, ethanol, propanol, butanol, etc. or with a polyglycol such as ethylene glycol pentaerythritol, or glycerol.

It is highly desirable to employ, as a precursor material, an alkenyl polymer having an average molecular weight or between about 600 and 5,000.

The derivatives of polyalkenylthiophosphonic acid include but are not limited to polyalkenylthiophosphonic acid, polyalkenylthiophosphonic acid esters, polyalkenylphosphonic acid, and polyalkenylphosphonic acid esters.

The reaction product preferred for use as the inhibiting compound is the pentaerythritol ester of polyisobutenylthiopho,phonic acid. This is commercially available and is also referred to as PBTPA.

PBTPA is prepared by mixing polyisobutene (avg. mol. wt of 750–2,000) with $P_2S_5$ (polybutene -$P_2S_5$ molar ratio of 0.9–1.25) in the presence of sulfur at 300° –600° F. until the reaction product is soluble in n-pentane. The product is diluted with paraffin base distillate, steamed for 4–10 hours at 350°–375° F., then dried with $N_2$ at 350°–375° F. The product is extracted with 50–100% by volume of methanol at 75°–150° F. to leave a raffinate containing polyisobutenylthiophosphonic acid. This material is reacted with pentaerythritol with the removal of a molecule of water to yield PBTPA.

Turbine combustion fuel oils are generally those hydrocarbon fuels having boiling ranges within the limits of about 150° to 600° F. and are designated by such terms as JP-4, JP-5, JP-7, JP-8, Jet A and Jet A-1. JP-4 and JP-5 are fuels defined by U.S. Military Specification MIL-T-5624-N, while JP-8 is defined by U.S. Military Specification MIL-T83133D. Jet A, Jet A-1 and Jet B are defined by ASTM specification D-1655. These temperatures are often what the turbine combustion fuel oil is subjected to prior to combustion.

Turbine combustion fuel oils also contain additives which are required to make the fuel oils conform to various specifications. U.S. Military Specification MIL-T-83133D describes these additives as antioxidants such as 2,6-di-tert-butyl-4-methylphenol (BHT), metal deactivators, static dissipators, corrosion inhibitors, and fuel system icing inhibitors. Despite these additives, the problem of fouling and deposit formation during the combustion of the turbine combustion fuel oils still persists, and may even be exacerbated by them. The present invention proves effective at inhibiting deposit formation in jet engines utilizing fuels containing these additives.

Turbine combustion fuel oils have very specific low limitations as to their olefin contents, sulfur levels and acid number contents, among other physical and chemical property specifications. Thus the mechanism of their fouling at the high temperatures they are subjected to in jet engines is not readily discernible. Further complicating treatment matters are the levels of oxygen dissolved in the turbine combustion fuel oil and the oxygenated atmosphere necessary for combustion.

The methods of the present invention have been found effective under jet engine operating conditions at reducing the amount of fouling in fuel nozzles and spray rings. The amount of fouling deposit formed by gums, varnishes and coke on surfaces such as the augmentor fuel manifolds, actuators and turbine vanes and blades is also found to be reduced. Regular usage of the derivatives of polyalkenylthiophosphonic acid will clean those areas which are fouled as a result of the combustion of the turbine combustion fuel oils and will maintain these areas in a clean condition. In general, the present inventors anticipate that any jet engine component that is involved in the combustion and exhaust process will have reduced fouling deposits as a result of the present treatment.

The total amount of the derivative of polyalkenylthiophosphonic acid used in the methods of the present invention is that amount which is sufficient to clean fouled fuel nozzles and spray rings and to reduce fouling deposit formation on jet engine combustion components and will vary according to the conditions under which the turbine combustion fuel oil is employed such as temperature, dissolved oxygen content and the age of the fuel. Conditions such as badly fouled engine components or where new fouling is problematic will generally require an increase in the amount of PATPA used over that used to maintain a clean engine.

Generally, the PATPA compound is added to the turbine combustion fuel oil in a range from 0.1 parts to 10,000 parts per million parts of turbine fuel oil. A combination of two or more derivatives of polyalkenylthiophosphonic acid may be added to the turbine combustion fuel oil along similar dosage ranges to achieve the desired cleaning and reduction of fouling deposits.

The compounds of the present invention can be applied to the turbine combustion fuel oil in any conventional manner and can be fed to the fuel oil neat or in any suitable solvent. Preferably, a solution is provided and the solvent is an organic solvent such as xylene or aromatic naphtha.

The preferred solution of the instant invention is pentaerythritol ester of polyisobutenylthiophosphonic acid (PBTPA) in aromatic naphtha in a ratio of 25% PBTPA active to 75% solvent.

The invention will now be further illustrated by the following examples which are included as being illustrative of the invention and which should not be construed as limiting the scope thereof.

EXAMPLES

To evaluate the additives of the following invention, a "dirty" engine test was performed. A dirty F100-PW-200 engine was selected for this testing. This engine is typical of engines in the field, i.e., a fully operational engine that has accumulated numerous operating hours and is partially clogged with fuel deposits.

This engine was initially borescoped and a videotape was made of fouling in the augmentor fuel ports, the unified fuel control, the combustor, on the fuel nozzle faces, on the first stage turbine vanes and blades and in the augmentor manifold tubes.

A performance check on JP-4 fuel was run and followed by a trim check on specification JP-8 fuel using the Automated Ground Engine Test System (AGETS). A spraying calibration was conducted using a flowmeter.

After completion of the trim check, the additive validation test was run for a total of 224 TAC (50 hours). The test consisted of 40 air-to-ground cycles and 28 air-to-air cycles representative of about six months of operation of an F-16. The air-to-ground cycles were run in groups of ten and the air-to-air cycles were run in groups of seven.

The mixture of JP-8 fuel and the inventive treatment was made onsite by blending 25 parts of PBTPA into 1 million parts of JP-8 fuel containing 21 parts of BHT. This blending was done by pouring the inventive additive into the top of a refueler truck and circulating within the truck to ensure proper mixing.

During the test, the following observations were made: (1) no engine operating anomalies related to the fuel were found; (2) engine noise was reported to be reduced; (3) augmentor flame became bluer; and (4) the exhaust was cleaner. The reduction in engine noise was probably due to cleaning of the mainburner fuel nozzle ports and to the burner functioning as designed. The bluer augmentor flame was probably due to fuel orifices in the augmentor opening up due to removal of deposits by the treatment. Lastly, no smoke or soot was observed coming from the exhaust.

After the test, the engine was again borescoped. All areas of the combustor, fuel nozzles and first stage turbine blades and vanes were unusually clean and free of carbon. In the unified fuel control, all parts with the exception of the Segment II port, were free of gums and varnishes. In the augmentor manifolds and spray ring, areas where light gummy deposits had been previously found, significant removal of these materials was observed.

Areas with a heavy coke deposit did not appear to be significantly cleaned. In all areas where there had been no deposits to start with, no deposit accumulated. In areas where the borescope scratched off deposit, no new deposit formed. Lastly, a visual examination of the exhaust nozzle area revealed that it was left clean and white, and not the usual sooty black color.

This testing demonstrates that the derivatives of polyalkenylthiophosphonic acid of the present invention are effective at reducing the formation of fouling deposits while maintaining clean areas in jet engines. They also demonstrated a reduction in smoke and soot emission from the exhaust as well as a reduction in engine noise.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A finished fuel composition comprising a turbine combustion fuel oil, an ester of polyalkenylthiophosphonic acid, and air, wherein said composition is present in a jet engine combustion chamber.

2. The composition as claimed in claim 1 wherein said derivative is a pentaerythritol ester.

3. The composition as claimed in claim 2 wherein said pentaerythritol ester of polyalkenylthiophosphonic acid is pentaerythritol ester of polyisobutenylthiophosphonic acid.

4. The composition as claimed in claim 1 wherein the alkenyl moiety of said polyalkenylthiophosphonic has a molecular weight of between about 600 and 5,000.

* * * * *